US005446950A

United States Patent [19]

Shibata

[11] Patent Number: 5,446,950

[45] Date of Patent: Sep. 5, 1995

[54] SHEARING APPARATUS

[75] Inventor: Kikuji Shibata, Matsubara, Japan

[73] Assignee: Shibata Iron Works Co., Ltd., Matsubara, Japan

[21] Appl. No.: 137,991

[22] Filed: Oct. 19, 1993

[30] Foreign Application Priority Data

Oct. 20, 1992 [JP] Japan ..... 4-307606
Oct. 20, 1992 [JP] Japan ..... 4-307607

[51] Int. Cl.[6] ..... D06C 13/00
[52] U.S. Cl. ..... 26/15 R
[58] Field of Search ..... 26/15 R, 15 L, 18, 8 R, 26/8 C, 9, 2 R, 7, 10 C, 15 FB; 83/401, 402, 100, 936, 937; 28/159

[56] References Cited

U.S. PATENT DOCUMENTS

| | | | |
|---|---|---|---|
| 1,139,609 | 5/1915 | Weaver | 26/15 R |
| 1,518,596 | 12/1924 | Mischke et al. | 26/15 R |
| 1,598,761 | 9/1926 | Dingfield et al. | 26/15 R |
| 1,665,217 | 4/1928 | Newman | 26/15 R |
| 2,606,355 | 8/1952 | Richardson | 26/15 R |
| 2,695,438 | 11/1954 | Bejeuhr | 26/15 R |
| 3,683,468 | 8/1972 | Kaufman | 26/15 R |
| 3,758,924 | 9/1973 | Holm | 26/16 |
| 4,649,606 | 3/1987 | Fay | 26/15 R |
| 4,882,818 | 11/1989 | Weathers et al. | 26/15 R |

FOREIGN PATENT DOCUMENTS

| | | | |
|---|---|---|---|
| 3235160 | 3/1984 | Germany | 26/15 R |

*Primary Examiner*—Peter Nerbun
*Assistant Examiner*—Amy B. Vanatta
*Attorney, Agent, or Firm*—Wenderoth, Lind & Ponack

[57] ABSTRACT

A shearing apparatus of this invention provides a uniform thread shearing, and a high discharging capability for sheared threads. Even when a discharging power is raised by increasing a suction power of a suction box, a cloth having threads subjected to shearing and passing over a shearing table, will not float from the shearing table thereby providing uniform shearing and preventing damage to the cloth. An outer wall having a shutter forming a slit is hinged to the suction box such that it is pivotable with respect to the wall of the suction box so that an angle between the outer wall and the suction box can be adjusted. Inside the suction box, there is provided a rotating blade device comprising a cylinder with a plurality of radially disposed ditches on the surface of the cylinder and longitudinally extending blades fixed substantially equidistantly and parallel each other. A fixed blade is disposed adjacent to the rotating blade device, confronting the slit of the suction box and forming a part of the wall of the suction box. A hollow shearing table having many small apertures in its surface and connected to a suction device is disposed in front of the slit, outside the suction box and is movable with respect to the slit of the suction box. A permeable conveyer may be disposed on the shearing table or a rotatable roller having many apertures may be disposed at the top edge of the shearing table to confront the slit of the suction box.

16 Claims, 8 Drawing Sheets

SHEARING APPARATUS

FIELD OF THE INVENTION

The invention relates to a shearing apparatus for shearing threads upon a cloth or the like (including leather, fur and unwoven fabric, hereinafter referred to only as a cloth), and further more specifically relates to a shearing apparatus for trimming raised threads on a surface of the cloth to thereby produce a cloth having a planar and shiny surface.

BACKGROUND OF THE INVENTION

A conventional shearing apparatus comprises as shown in FIG. 10 and FIG. 11, a plurality of spiral cutter blades 36 disposed on an outer surface of a cylinder 34 and a fixed blade 37 disposed under the spiral cutter blades. Threads on a cloth 24 are sheared while the cloth passes over a shearing table 38 and relative positions of the spiral cutter blades and the fixed blade are adjustable and both the spiral blades and the fixed blades are movable upwardly and downwardly relative to the shearing table 38.

In the above described conventional shearing apparatus, to increase a shearing efficiency, it is necessary to rotate the cylinder having the spiral blades at a high speed or to increase the number of the spiral blades so that they are disposed closely to each other on the cylinder. However, when the spiral blades rotate at a very high speed, wind caused by the rotating blades blows down the threads on the cloth, such that the shearing is not accomplished over the whole cloth. While the spiral blades are disposed closely to each other, sheared threads get stuck between the blades, thereby causing problems with the machine.

Further, sheared threads float in the air, thereby harming the environment. They also stick to the blades and fall down onto the cloth thereby preventing smooth shearing.

To solve the problems of sticking, a suction nozzle near the blades is proposed but it is not a complete solution. Further, if the suction power is increased, the cloth passing over the shearing table floats up from the table such that uniform shearing is not achieved or the cloth itself is damaged.

SUMMARY OF THE INVENTION

An objective of the invention is to provide a shearing apparatus having a uniform shearing capability and a high discharging capability for the sheared threads.

Another objective of this invention is to provide a shearing apparatus which prevents a cloth from floating above a shearing table to thereby ensure that the threads are uniformly sheared and that the cloth is not damaged even when the cloth is drawn toward the shearing table by a high suction force.

The present invention aims to solve the above described problems and is embodied as a shearing apparatus comprising a suction box having a slit, a rotating blade device disposed inside the suction box and confronting the slit, a fixed blade disposed along an outer wall of the suction box and confronting the slit, and a shearing table disposed outside the suction box such that a top edge of the shearing table confronts the slit.

The outer wall of the slit is pivotably hinged to the suction box such that an angle between the outer wall and the suction box can be adjusted. A shutter is disposed on the outer wall of the suction box.

The rotating blade comprises a cylinder having plurality of radially disposed ditches (recesses) on the surface of the cylinder where blades extending lengthwise are fixed parallel each other. The shearing table is movable with respect to the suction box, and the suction box is fixed.

In a preferred form of the invention a shearing apparatus comprises a suction box having a slit and being connected to a suction device, a rotating blade device disposed inside the suction box and confronting the slit, a fixed blade disposed along an outer wall of the suction box and confronting the slit, and a hollow shearing table connected to a suction device. The hollow shearing table is disposed outside the suction box and has many apertures on its surface and a top edge which confronts the slit.

A permeable belt conveyer may be slidably disposed on the hollow shearing table. A roller having apertures on its surface may be disposed at the top edge of the hollow shearing table so as to confront the slit of the suction box. The hollow shearing table is movable with respect to the suction box, and the suction box is fixed.

In operation of the above described shearing apparatus, a negative pressure is maintained inside the suction box by suction of the air by the suction device connected to the suction box. Threads of the cloth are sheared by the rotating blade device and the cooperating fixed blade while air is drawn through the slit of the suction box. The air drawn through the slit into the suction box causes a wind which causes the threads on the cloth to be pulled upwardly to an erect position so that they can be subjected to shearing, thereby providing for uniform shearing. The sheared threads are blown into the suction box through the blades of the rotating blade device, and thus the sheared threads do not become stuck between the blades disposed on a rotating cylinder of the rotating blade device. The suction power need not necessarily be large to draw the sheared threads into the suction box, and thus the cloth subjected to shearing will not float from the surface of the shearing table.

The width, position and angle of the slit can be adjusted as necessary to accommodate the characteristics of the cloth subjected to shearing, by adjusting the positions of the outer wall which defines a part of the slit, the shutter and the fixed blade. Air inhaled from the slit passes between the blades disposed on the surface of the cylinder, through the ditches equidistantly disposed along the cylinder, and into the suction box very fast. Consequently threads on the cloth are erected and stretched so as to provide for uniform shearing, and the sheared threads smoothly flow into the suction box without getting stuck between the blades of the rotating blade device. The relative position between the shearing table and the rotating blade device or the fixed blade can be adjusted by moving laterally or pivoting the shearing table.

Suction devices connected to the suction box and the hollow shearing table are operated to cause negative pressure inside the suction box and the hollow shearing table. A wind caused by the negative pressure draws up and stretches or straightens the threads on the cloth so that uniform shearing can be obtained. Threads are sheared while they contact the rotating blade device and the fixed blade and the wind passes through the slit into the suction box carrying the sheared threads into the suction box, while the cloth subjected to shearing and moving on the shearing table is drawn against the hollow shearing table and prevented from floating from the shearing table. When a permeable conveyer belt is disposed on the shearing table, movement thereof is synchronized with the movement of the cloth which is drawn onto the shearing table by the negative pressure to therefore reduce kinetic resistance between the cloth and the shearing table.

When the sheet of cloth is of a short length, the sheet of cloth is placed on the permeable belt conveyer so as to be drawn onto the shearing table by the negative pressure, and the conveyer belt carries the sheet to the blades for shearing. When a roller having apertures around its surface is disposed at the top edge of the shearing table, kinetic resistance between the cloth and the shearing table is reduced as it rolls synchronously with the movement of the permeable belt conveyer. During operation, the relative position between the shearing table and the rotating blade device or fixed blade can be adjusted by moving laterally or pivoting the shearing table.

According to the invention of this application, the air drawn in through the slit flows rather fast into the suction box, and threads on the cloth moving on the shearing table are erected and stretched by the wind caused by the air flow. Therefore, even when the rotating blade device rotates at very high speed, threads are sheared uniformly and effectively and one can enjoy a high shearing efficiency. Sheared threads are blown into the suction box through the blades of the rotating blade device and there is no worry that the sheared threads will become stuck between the blades disposed on a rotating cylinder of the rotating blade device. The suction power need not necessarily be large to draw the sheared threads into the suction box, and therefore, the cloth subjected to shearing will not float from the surface of the shearing table and the cloth will not be damaged.

The width, position and angle of the slit can be adjusted as necessary depending on the characteristics of the cloth subjected to shearing by moving the position of the outer wall, the position of the blade and the position of the shutter. In this manner, uniform and effective shearing can be provided. Air inhaled through the slit passes between the blades disposed on the surface of the cylinder, through the ditches equidistantly disposed along the cylinder, and into the suction box very quickly. Consequently, threads on the cloth are erected and stretched to thereby improve shearing uniformity and allow the sheared threads flow smoothly into the suction box without getting stuck between the blades of the rotating blade device.

An adjustment of the relative position between the shearing table and rotating blade device or fixed blade is carried out as follows. The rotating blade and the fixed blade are fixed and the shearing table, which is lighter in weight than the suction box containing the rotating blade device and the fixed blade, can be moved to adjust the relative position. The adjustability is improved compared with the prior art adjustability in which the rotating blade device or fixed blade can be moved vertically. Further it is possible to prevent vibration of the rotating blade device when rotating at very high speed, and thus the shearing operation is stable and effective.

A suction device connected to the hollow shearing table creates a negative pressure inside the hollow shearing table, and the cloth subjected to shearing moves along the shearing table and is drawn onto the hollow shearing table to prevent it from floating from the shearing table and becoming damaged. In this manner, uniform shearing is obtained. When a permeable conveyer belt is provided, its movement is synchronized with the movement of the cloth which is absorbed onto the shearing table by the negative pressure, to thereby reduce a kinetic resistance between the cloth and the shearing table. Even a sheet of cloth which is short in length can be subjected to shearing by drawing the sheet onto the shearing table with the negative pressure.

When a roller is disposed at the top edge of the shearing table, kinetic resistance between the cloth and the shearing table is reduced to provide a smooth shearing operation.

An adjustment of the relative position between the shearing table and the rotating blade device or fixed blade can be carried out as follows. The position of the rotating blade and the fixed blade are fixed and the shearing table, which is lighter in weight than the suction box containing the rotating blade device and the fixed blade, is moved to adjust the relative position. An adjustability is improved compared with the prior art adjusting process. Further even if the rotating blade device rotates at very high speed, vibration of the rotating blade device is suppressed and the shearing operation is stable to thereby improve the shearing efficiency.

DETAILED DESCRIPTION OF THE INVENTION

Figure 1A:
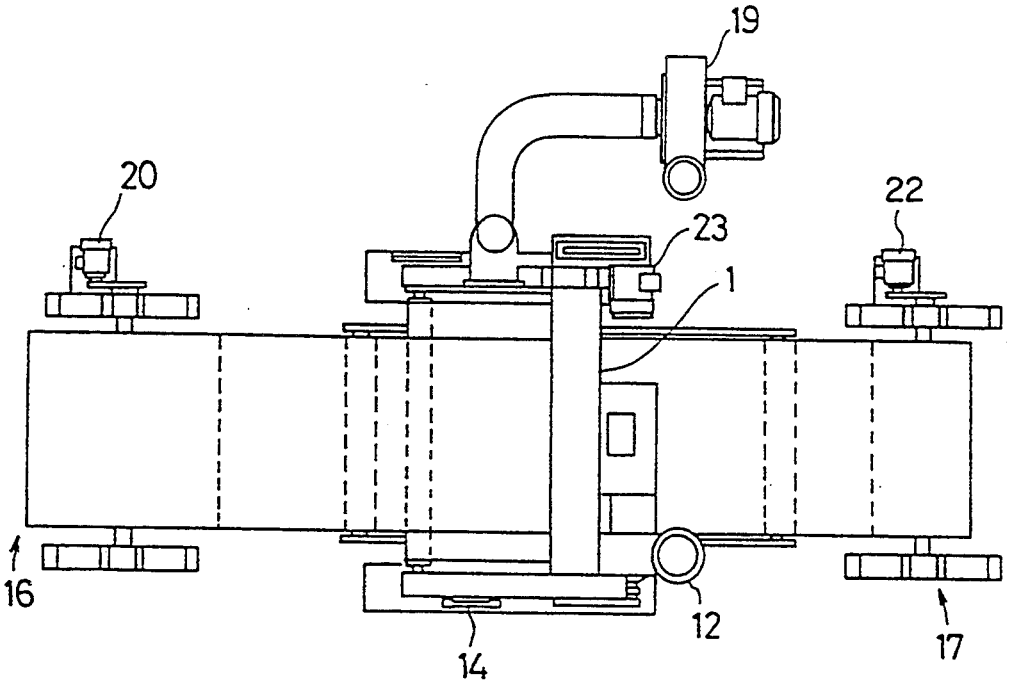
FIGS. 1(*a*) and 1(*b*) are a plan view and an elevation view of the shearing apparatus of the invention and an auxiliary apparatus of the shearing apparatus.
Figure 1B:
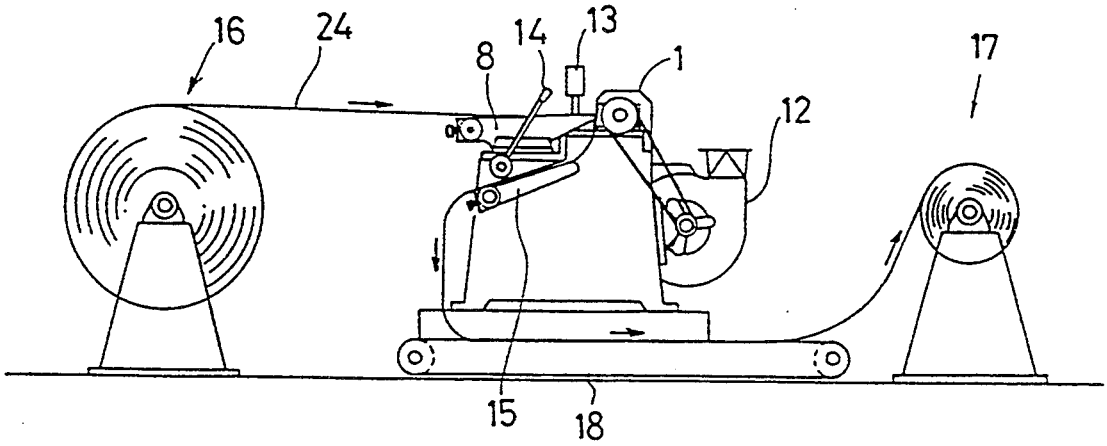
Figure 2:
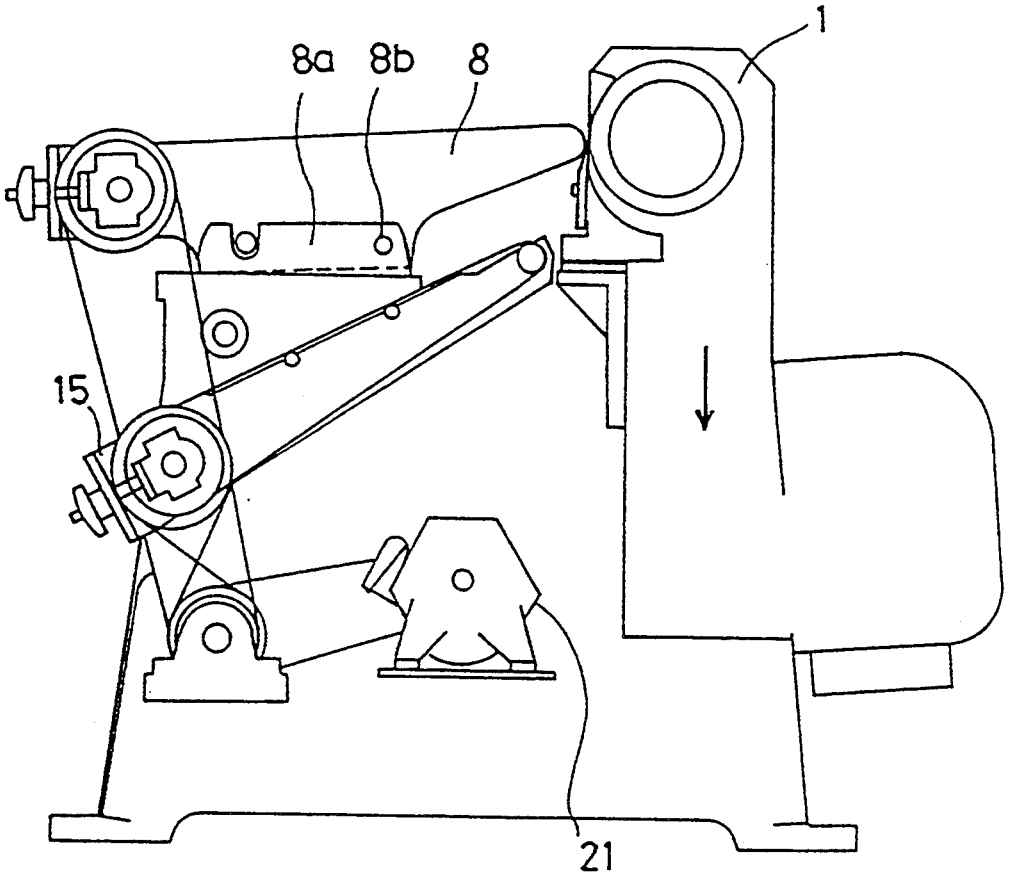
FIG. 2 is an elevation view of the shearing apparatus.
Figure 3:
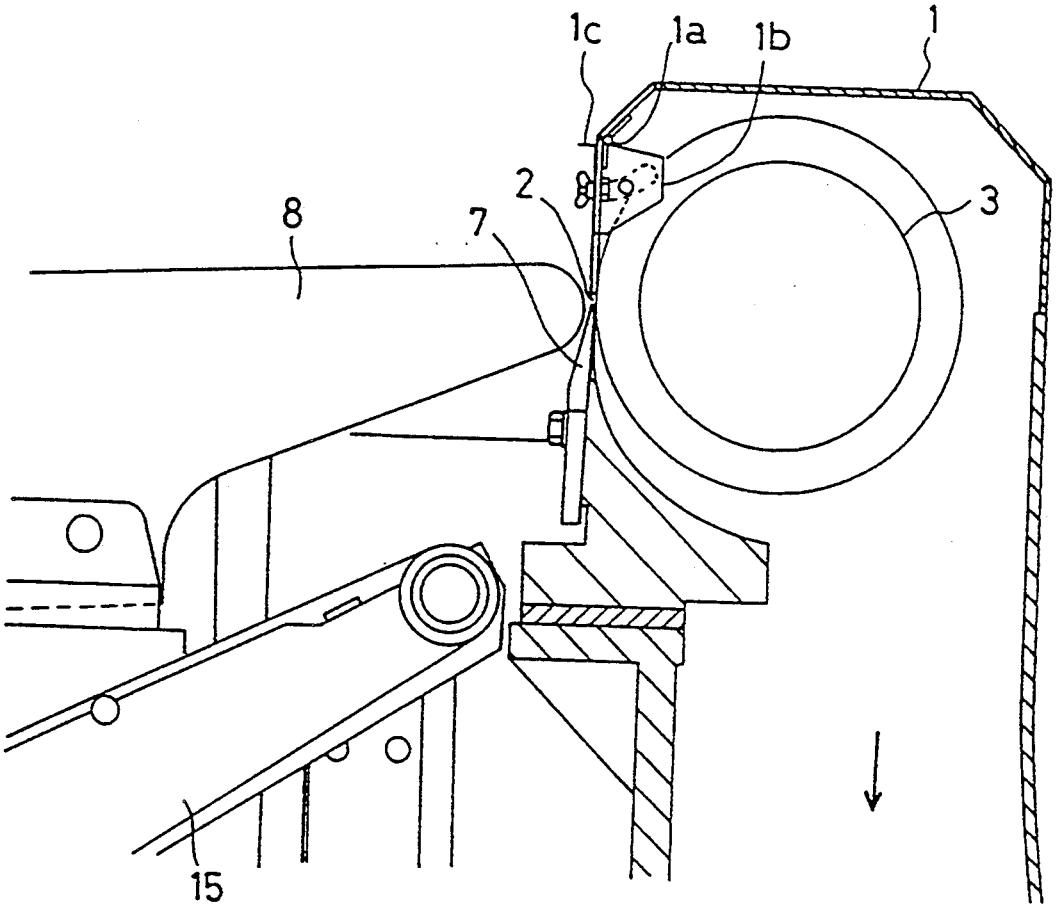
FIG. 3 is an enlarged elevation view of the shearing apparatus.
Figure 4:
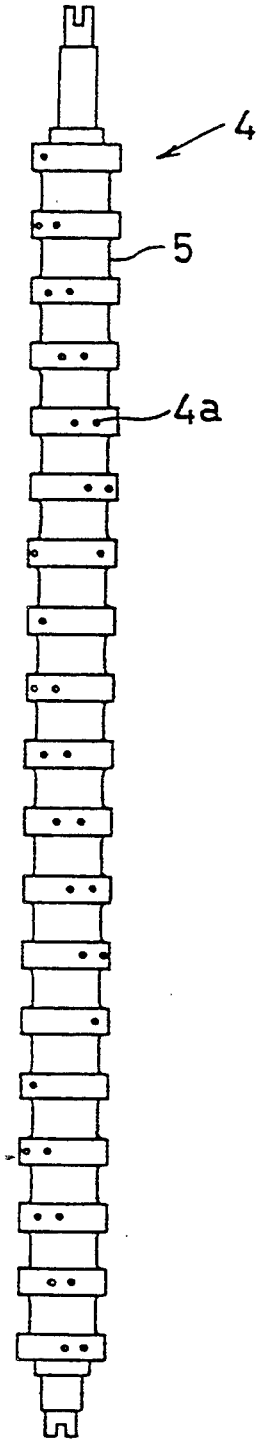
FIG. 4 shows a cylinder with rotating blades.
Figure 5:
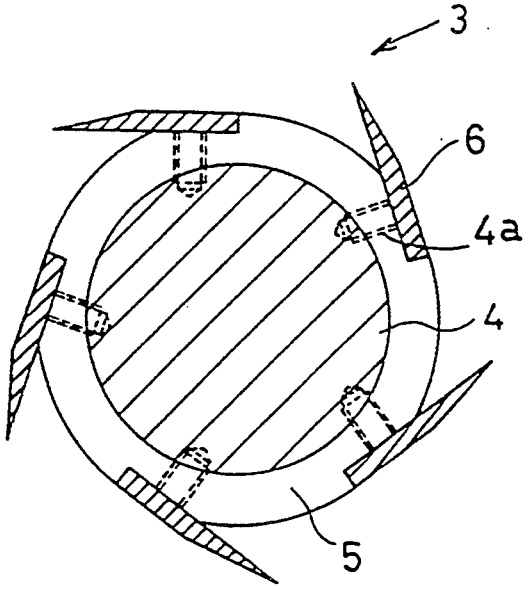
FIG. 5 is a sectional view showing the rotating blades.

The invention is further explained by reference to embodiments of the invention.

A shearing apparatus of the invention comprises a suction box 1, a rotating blade device 3, a fixed blade 7, a shearing table 8, an upper guide table 15 and a lower guide table 18.

A slit 2 is disposed at the side of the suction box 1, with which a suction means (or device) 12 is connected through a shutter (not shown) for controlling the suction power. Inside the suction box 1, there is disposed the rotating blade device 3 confronting the slit 2, and outside the suction box 1 there is disposed a fixed blade 7 close to (adjacent) the slit 2.

The slit 2 is defined by an outer wall 1*b*, which is pivotably hinged to the suction box 1 by a hinge 1*a* for adjusting an angle of the outer wall with respect to the suction box and the fixed blade 7. Further a shutter 1*c* is slidably disposed at the outer wall 1*b* for adjusting a width of the slit 2.

The rotating blade device 3 consists of a cylinder 4 and several spiral blades 6 extending lengthwise, more specifically 5 to 8 blades are placed in almost parallel in the ditches 5 disposed along a surface of the cylinder.

In this embodiment, each blade 6 is fixed to the cylinder with bolts (not shown) and threaded holes 4*a* disposed in the cylinder, thereby preventing the blades from bending during a shearing operation and keeping a shearing angle at a small value, for example 7 to 15 degree (almost parallel). Consequently, threads on the cloth 24 are effectively and uniformly sheared because the angle between the rotating blade and the fixed blade is small.

The manner in which the blades are fixed to the cylinder is not limited to the above described manner; rather, the blades can be fixed to the cylinder in other ways, such as without disposing ditches on the surface of the cylinder or such that flanges are disposed at both end of each blade where the blade is fixed to the cylinder with bolts.

The rotating blade device 3 is driven by an electric motor 23 via a pulley and a driving belt.

Figure 6:
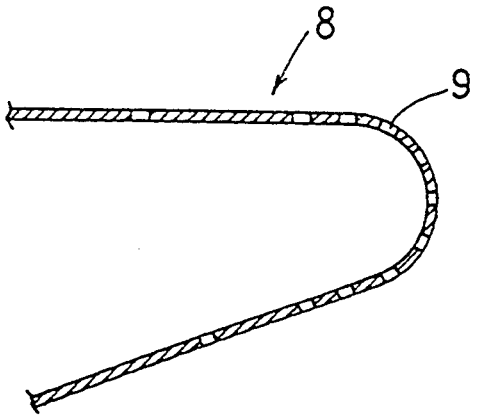
FIG. 6 is an example of a shearing table.

A shearing table 8 is disposed in front of the slit 2. The shearing table is hollow as shown in FIG. 6, having many apertures 9 on its surface with which a suction means (device) 19 is connected through a shutter (not shown) to thereby control the suction power. It is preferable to dispose a larger number of apertures 9 in the area confronting the slit 2 than in the other parts of the shearing table. A section of the shearing table is formed as a sector as shown in FIG. 6 to FIG. 9 for spreading the threads and preventing the threads from twining with each other during the shearing operation.

Figure 7:
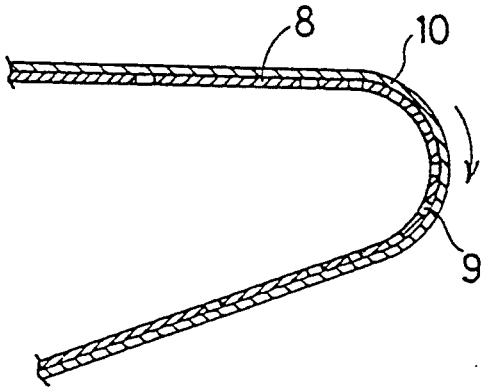
FIG. 7 is an example of a shearing table.

Another embodiment of a modified shearing table is shown in FIG. 7, in which a permeable conveyer belt 10 is disposed on the shearing table.

Figure 8:
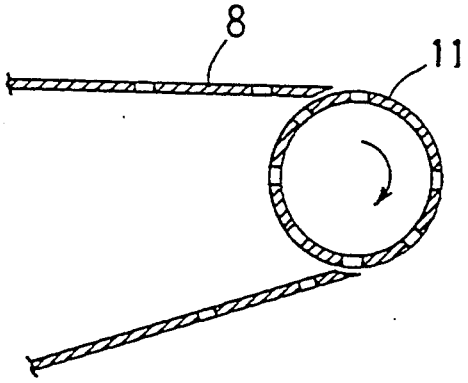
FIG. 8 is an example of a shearing table.

A further embodiment of the shearing table is shown in FIG. 8, in which a rolling cylinder 11 having small apertures on its surface is disposed at the top edge of the shearing table where the shearing table faces the slit 2 of the suction box.

Figure 9:
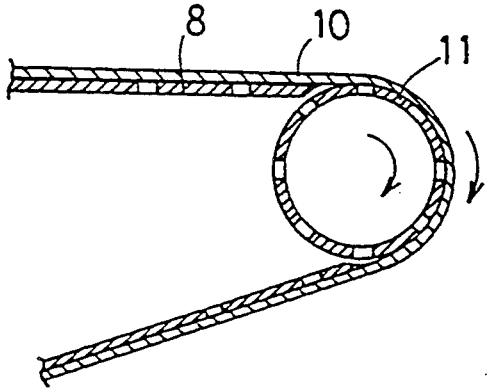
FIG. 9 is an example of a shearing table.
Figure 10:
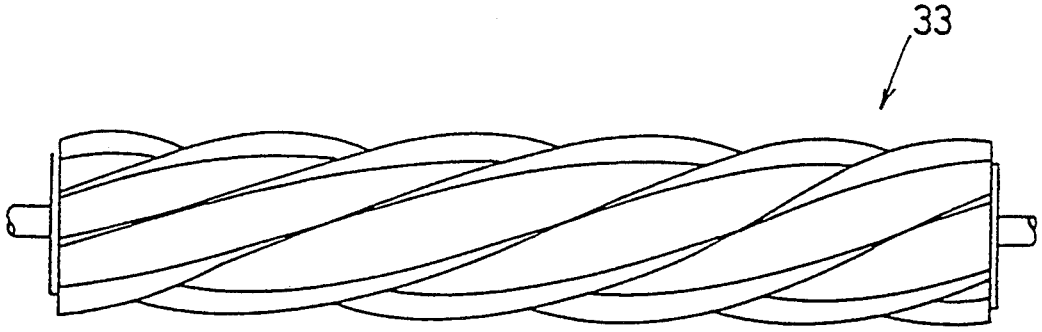
FIG. 10 (PRIOR ART)
FIG. 10 shows rotating blades of a conventional shearing apparatus.
Figure 11:
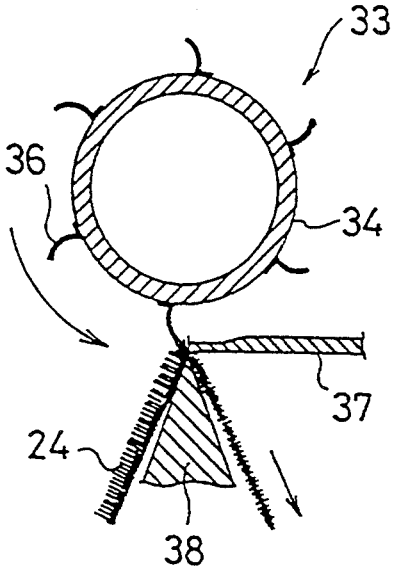
FIG. 11 (PRIOR ART)
FIG. 11 is a schematic diagram of a conventional shearing apparatus.

Another embodiment of the shearing table is shown in FIG. 9, in which a rolling cylinder 11 having small apertures on its surface is disposed at the top edge of the shearing table and further a permeable conveyer belt 10 is disposed on the rolling cylinder where the shearing table faces the slit 2 of the suction box.

The conveyer belt consists of a roughly woven fabric, a fabric having small apertures, or a wire net or the like, which are all permeable, and is driven by an electric motor 21 via a pulley and a driving belt.

The shearing table 8 is movable to thereby adjust the position of the shearing table relative to the rotating blade device 3 and the fixed blade 7.

The shearing table is pivotably mounted on a mounting table 8*a* via a rack and pinion mechanism (not shown). When an operator moves a lever into an operation position, the shearing table 8 pivots to change its position with respect to the slit 2 of the suction box 1 to thereby adjust a distance between the top edge of the shearing table and the slit 2. The shearing table is pivotable about an axis 8*b* so that an angle of the shearing table with respect to the fixed blade is adjustable.

In this embodiment, the blades (the rotating blades and the fixed blade) and the shearing table are arranged at almost the same level, but the layout of these parts is not restricted to this arrangement. They may also be arranged vertically.

The upper guide table 15 and the lower guide table, both of which guide the cloth subjected to shearing, include belt conveyers consisting of a wire net or a fabric driven by the electric motor 21 via a pulley and a driving belt.

There is also provided a supply roller 16 for supplying the cloth 24 to the shearing apparatus, and a receiving roller 17 for receiving the processed cloth. These rollers are driven by electric motors 20 and 22.

Operation of the shearing apparatus is controlled through a console table 13.

The width of the slit 2 is adjusted by changing the position of the outer wall 1b, the shutter 1*c* of the outer wall, and the fixed blade, depending on the features of the cloth subjected to shearing. Then the position and the angle of the shearing table 8 with respect to the fixed blade or the suction box are adjusted by operating the lever 14, also depending on the features of the cloth. The cloth is placed on the supply roller 16 over the shearing table 8, the upper guide table 15, the lower guide table 18, and wound on the receiving roll 17. The electric motors 20, 21, 22 drive the supply roller and the receiving roller and cause the cloth to be supplied to the shearing apparatus. The rotating blade is driven by the electric motor 23, and shearing is conducted with the rotating blade and the fixed blade. During operation of the shearing apparatus, the inside of the suction box is kept at a negative pressure by the operation of the suction means (device) 12 to cause air to be drawn through the slit 2 into the suction box 1 from the outside of the suction box.

The air is introduced smoothly into the suction box between the blades 6, 6 of the rotating blade through the ditches 5 disposed on an outer periphery of the cylinder 4.

The threads of the cloth are raised and stretched by the air flow and therefore shearing is conducted properly and sheared threads are easily introduced into the suction box by the air flow without getting stuck between the blades 6, 6 of the rotating blade device 3.

The suction means 19 does not necessarily need great suction power to inhale the sheared threads, and the suction means 19 draws the air through the shearing table to cause the cloth to stick onto the shearing table so that the cloth passing over the shearing table will not float up from the shearing table.

Furthermore, as shown in FIG. 7 and FIG. 9, in which a permeable conveyer belt 10 is shown disposed on the shearing table 8 and driven by the electric motor, shearing threads on the cloth are conducted without problems and, in addition, it is possible to shear threads of a sheet of cloth having a short length by sucking the sheet of cloth onto the conveyer belt.

As shown in FIG. 8 and FIG. 9, the rolling cylinder 11 has small apertures in its surface and is disposed at the top edge of the shearing table 8 where the shearing table faces the slit 2 of the suction box 1, so that threads are sheared very smoothly.

What we claim is:

1. A shearing apparatus for use in shearing threads of a cloth, said shearing apparatus comprising:

a hollow suction box having an opening at a front side thereof;

a cloth-supporting shearing table confronting said opening of said hollow suction box;

an outer wall pivotally mounted to said hollow suction box and covering a portion of said opening of said hollow suction box;

a shutter member slidably mounted to said outer wall;

a fixed blade mounted to said hollow suction box adjacent said opening thereof and in confronting relation to said shutter member, an elongated slit being defined between said fixed blade and said shutter member and being adjustable in width upon sliding of said shutter member relative to said outer wall;

suction means for drawing air out of said hollow suction box to reduce a pressure therein and cause air to flow into said hollow suction box through said slit and to draw free ends of the threads of the cloth through said slit;

a rotary blade device rotatably mounted inside said hollow suction box adjacent said slit; and wherein said rotary blade device comprises an elongated cylinder having a plurality of spaced apart circumferential recesses formed in a periphery of said cylinder, and a plurality of elongated spiral blades fixed about said periphery of said cylinder in parallel with one another.

2. A shearing apparatus as recited in claim 1, wherein said cloth-supporting shearing table is disposed wholly outside said hollow suction box and in confronting relation to said slit.

3. A shearing apparatus as recited in claim 1, wherein a position of said shearing table is adjustable relative to said slit.

4. A shearing apparatus as recited in claim 1, wherein said cloth-supporting shearing table has a cloth-supporting surface, and said cloth-supporting surface has a plurality of holes therein; and a suction means is operably connected to said plurality of holes in said cloth-supporting surface of said shearing table for drawing air therethrough to draw the cloth against said cloth-supporting surface.

5. A shearing apparatus as recited in claim 4, wherein said shearing table is hollow, and said suction means is operable to draw the air through said holes in said cloth-supporting surface of said shearing table by drawing air out of said hollow shearing table.

6. A shearing apparatus as recited in claim 1, wherein a permeable belt conveyer is slidably mounted on said cloth-supporting shearing table.

7. A shearing apparatus as recited in claim 1, wherein a cylindrical roller, having apertures through a surface thereof, is mounted adjacent said cloth-supporting shearing table and confronting said slit.

8. A shearing apparatus as recited in claim 7, wherein a permeable belt conveyer is slidably mounted on said cloth-supporting shearing table and extends about a portion of said cylindrical roller.

9. A shearing apparatus for use in shearing threads of a cloth, said shearing apparatus comprising:

a hollow suction box having an opening at a front side thereof;

a cloth-supporting shearing table disposed wholly outside said hollow suction box and confronting said opening of said hollow suction box;

an outer wall pivotally mounted to said hollow suction box and covering a portion of said opening of said hollow suction box;

a shutter member slidably mounted to said outer wall;

a fixed blade mounted to said hollow suction box adjacent said opening thereof and in confronting relation to said shutter member, an elongated slit being defined between said fixed blade and said shutter member and being adjustable in width upon sliding of said shutter member relative to said outer wall;

suction means for drawing free ends of the threads of the cloth, mounted on said cloth-supporting shearing table outside said hollow suction box, through said slit and into said hollow suction box; and a rotary blade device rotatably mounted inside said hollow suction box adjacent said slit.

10. A shearing apparatus as recited in claim 9, wherein said rotary blade device comprises an elongated cylinder having a plurality of spaced apart circumferential recesses formed in a periphery of said cylinder, and a plurality of elongated spiral blades fixed about said periphery of said cylinder in parallel with one another; and said cloth-supporting shearing table is disposed in confronting relation to said slit.

11. A shearing apparatus as recited in claim 9, wherein a position of said shearing table is adjustable relative to said slit.

12. A shearing apparatus as recited in claim 9, wherein said cloth-supporting shearing table has a cloth-supporting surface, and said cloth-supporting surface has a plurality of holes therein; and a suction means is operably connected to said plurality of holes in said cloth-supporting surface of said shearing table for drawing air therethrough to draw the cloth against said cloth-supporting surface.

13. A shearing apparatus as recited in claim 12, wherein said shearing table is hollow, and said suction means is operable to draw the air through said holes in said cloth-supporting surface of said shearing table by drawing air out of said hollow shearing table.

14. A shearing apparatus as recited in claim 9, wherein a permeable belt conveyer is slidably mounted on said cloth-supporting shearing table.

15. A shearing apparatus as recited in claim 9, wherein a cylindrical roller, having apertures through a surface thereof, is mounted adjacent said cloth-supporting shearing table and confronting said slit.

16. A shearing apparatus as recited in claim 15, wherein a permeable belt conveyer is slidably mounted on said cloth-supporting shearing table and extends about a portion of said cylindrical roller.

* * * * *